US010008812B1

(12) United States Patent
Hamner et al.

(10) Patent No.: US 10,008,812 B1
(45) Date of Patent: Jun. 26, 2018

(54) CABLE ASSEMBLY HAVING A GROUNDED CABLE HARNESS

(71) Applicant: TE CONNECTIVITY CORPORATION, Berwyn, PA (US)

(72) Inventors: Richard Elof Hamner, Hummelstown, PA (US); Jared Evan Rossman, Dover, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/658,810

(22) Filed: Jul. 25, 2017

(51) Int. Cl.

| | |
|---|---|
| ***H01R 9/03*** | (2006.01) |
| ***H01R 13/6592*** | (2011.01) |
| ***H01R 13/6585*** | (2011.01) |
| ***H01B 7/00*** | (2006.01) |
| ***H01B 11/18*** | (2006.01) |
| ***H01R 13/502*** | (2006.01) |

(52) U.S. Cl.
CPC ..... *H01R 13/6592* (2013.01); *H01B 7/0045* (2013.01); *H01B 11/1895* (2013.01); *H01R 13/502* (2013.01); *H01R 13/6585* (2013.01)

(58) Field of Classification Search
CPC ..... H01R 13/6593
USPC ..... 439/607.47, 607.41
See application file for complete search history.

(56) References Cited

U.S. PATENT DOCUMENTS

| | | | | |
|---|---|---|---|---|
| 6,036,543 | A * | 3/2000 | Panis | H01R 13/516 439/607.01 |
| 7,074,087 | B2 * | 7/2006 | Szczesny | H01R 9/032 439/607.41 |
| 7,188,415 | B2 | 3/2007 | Robinson et al. | |
| 8,353,721 | B2 * | 1/2013 | Deimel | H05K 9/0018 439/607.41 |
| 8,376,779 | B2 * | 2/2013 | Metral | H01R 13/502 439/607.41 |
| 2002/0002005 | A1 | 1/2002 | Whybrow | |
| 2006/0035522 | A1 | 2/2006 | Kuroda et al. | |
| 2009/0068890 | A1 | 3/2009 | Horiuchi et al. | |
| 2014/0051295 | A1 | 2/2014 | Westman et al. | |

FOREIGN PATENT DOCUMENTS

| | | | |
|---|---|---|---|
| DE | 102009049133 | A1 | 5/2010 |
| WO | 9108961 | A | 5/1991 |

* cited by examiner

*Primary Examiner* — Phuong Dinh

(57) ABSTRACT

Cable assembly includes an assembly housing having an interior cavity and a loading passage that provides access to the interior cavity. The assembly housing has an inner housing surface that defines the loading passage. The cable assembly also includes a cable harness having insulated wires and a conductive shielding layer. The insulated wires extend through a cable passage defined by the shielding layer. The cable harness also includes a discrete ferrule positioned within the cable passage at an end of the cable passage. The discrete ferrule has an outer ferrule surface that is surrounded by the shielding layer. The inner housing surface and the outer ferrule surface interface each other along a harness-housing seam. The harness-housing seam includes a projection and a recess that receives the projection. The shielding layer is stretched by the projection within the harness-housing seam and electrically grounds the cable harness to the assembly housing.

20 Claims, 9 Drawing Sheets

CABLE ASSEMBLY HAVING A GROUNDED CABLE HARNESS

BACKGROUND

The subject matter herein relates generally to cable assemblies that include cable harnesses for interconnecting communication systems or devices.

Communication systems, such as routers, servers, switches, redundant arrays of inexpensive disks (RAIDs), uninterruptible power supplies (UPSs), host bus adapters (HBAs), supercomputers, and the like, may be large complex systems that have a number of components interconnected to one another through different types of cable assemblies. For example, cable backplane (or cable midplane) systems include several daughter card assemblies that are interconnected to one another through cable assemblies. The daughter card assemblies of such systems may also be interconnected with remote components or devices through different types of cable assemblies. An example of such cable assemblies includes pluggable input/output (I/O) cable assemblies.

Cable assemblies may include a cable harness (or multicore cable), one or more electrical connectors, and an assembly housing that holds the electrical connector(s) and is coupled to the cable harness. The electrical connector may be positioned within an interior cavity of the assembly housing and have a front end that is presented to an exterior of the assembly housing. The cable harness has multiple individual cables that are received through a loading passage of the assembly housing. When the cable assembly is fully constructed, an interior cavity exists within the assembly housing. The individual cables extend through the interior cavity and couple to corresponding contacts of the electrical connector that may be located, for example, at a back end of the electrical connector.

It is generally desirable to mitigate electromagnetic interference (EMI) leakage in which the EMI generated from within the interior cavity escapes to an exterior of the assembly housing. This can be challenging because the assembly housing typically has several parts, such as housing shells and the cable harness, that are connected to one another. Tight tolerances and compliant conductive materials are often necessary to minimize seams that allow EMI leakage. Tighter tolerances and additional shielding components, however, may not be cost-effective and/or may not provide the same effectiveness for mitigating EMI leakage.

Accordingly, a need remains for a cable assembly having a cable harness that can be reliably grounded to an assembly housing of the cable assembly.

BRIEF DESCRIPTION

In an embodiment, a cable assembly is provided. The cable assembly includes an assembly housing having an interior cavity and a loading passage that provides access to the interior cavity. The assembly housing has an inner housing surface that defines the loading passage. The cable assembly includes an electrical connector having a back end disposed within the interior cavity and surrounded by the assembly housing. The electrical connector has a front end that is configured to engage an external mating connector. The cable assembly also includes a cable harness having insulated wires and a conductive shielding layer. The insulated wires extend through a cable passage defined by the shielding layer. The cable harness also includes a discrete ferrule positioned within the cable passage at an end of the cable passage. The discrete ferrule has an outer ferrule surface that is surrounded by the shielding layer. The inner housing surface and the outer ferrule surface interface each other along a harness-housing seam. The harness-housing seam includes a projection and a recess that receives the projection. The shielding layer is stretched by the projection within the harness-housing seam and electrically grounds the cable harness to the assembly housing.

In some aspects, the discrete ferrule has an external flange disposed outside of the cable passage and within the interior cavity. The external flange engages the assembly housing and secures the cable harness to the assembly housing.

In some aspects, the cable harness includes an outer securing member at a covered segment of the cable harness. The securing member surrounds the shielding layer and holds the shielding layer to the discrete ferrule such that the shielding layer is disposed between the securing member and the discrete ferrule.

In some aspects, the outer ferrule surface includes the recess and the inner housing surface includes the projection.

In some aspects, the cable passage has a central axis. The projection extends in a radial direction with respect to the central axis. Optionally, the harness-housing seam extends essentially entirely around the central axis.

In some aspects, the harness-housing seam has a gap that is approximately equal to a thickness of the shielding layer.

In some aspects, the assembly housing includes first and second housing shells. The first and second housing shells define portions of the loading passage. Optionally, each of the first and second housing shells includes a portion of the inner housing surface that forms the harness-housing seam.

In some aspects, the electrical connector includes a contact array having a plurality of contact sub-assemblies. Each contact sub-assembly includes a pair of signal contacts and a ground contact that surrounds the pair of signal contacts, wherein the electrical connector is configured to transmit data signals at a data rate of at least 10 gigabits per second. Optionally, the insulated wires includes at least twenty-four (24) of the insulated wires.

In an embodiment, a cable harness is provided that includes a conductive shielding layer defining a cable passage that extends along a central axis. The cable harness also includes a group of insulated wires surrounded by the shielding layer and extending through the cable passage. The cable harness also includes a discrete ferrule positioned at least partially within the cable passage at an end of the cable passage. The discrete ferrule surrounds the group of insulated wires. The discrete ferrule has an outer ferrule surface. The shielding layer directly surrounds the outer ferrule surface. The outer ferrule surface includes a grounding perimeter. The grounding perimeter includes at least one of a projection or a recess and extends around the central axis. The grounding perimeter coincides with a plane that is perpendicular to the central axis. The shielding layer extends over the grounding perimeter.

In some aspects, the discrete ferrule has an external flange disposed outside of the cable passage.

In some aspects, the cable harness also includes an outer securing member at a covered segment of the cable harness. The securing member surrounds and holds the shielding layer to the discrete ferrule such that the shielding layer is disposed between the securing member and the discrete ferrule.

In some aspects, the grounding perimeter is devoid of a projection.

In some aspects, the cable passage has a central axis and the grounding perimeter extends essentially entirely around the central axis.

In some aspects, the discrete ferrule has an inner ferrule surface that defines an inner diameter of the discrete ferrule. The inner diameter includes a first inner diameter and a second inner diameter that is greater than the first inner diameter. The first inner diameter of the discrete ferrule coincides with the plane. The second diameter of the discrete ferrule occurs closer to an end of the cable harness.

In some aspects, the discrete ferrule includes multiple ferrule sections that are coupled to one another.

In some aspects, the discrete ferrule includes first and second ferrule sections. Each of the first and second ferrule sections defines an open-sided ferrule channel. The ferrule channels combine to form a ferrule passage. The insulated wires extend through the ferrule passage.

In some aspects, the group of insulated wires includes at least twenty-four (24) of the insulated wires.

DETAILED DESCRIPTION

Embodiments set forth herein include cable assemblies and cable harnesses that are configured to contain electromagnetic interference (EMI). The cable assemblies include assembly housings that hold one or more electrical connectors. The electrical connectors are configured to transmit electrical power and/or data signals. The assembly housing includes an interior cavity where at least a portion of the electrical connector is disposed. The assembly housing has one or more loading passages that each receive a portion of a cable harness. A cable harness includes insulated wires and a shielding layer that surrounds the insulated wires. The cable harness also includes a discrete ferrule that surrounds a covered segment of the cable harness and engages the assembly housing. A harness-housing seam may be defined by the cable harness and the assembly housing. Embodiments are configured to reduce or impede EMI leakage through the harness-housing seam.

The insulated wires are terminated to corresponding electrical contacts of the electrical connector(s) within the interior cavity. In some embodiments, the insulated wires may form communication cables in which two insulated wires extend alongside each other. For example, a single communication cable may include a differential pair of insulated wires that are surrounded by a common wrap or jacket. Examples of such communication cables include parallel-pair cables or twisted-pair cables. Cable harnesses may include multiple communication cables.

Figure 1:
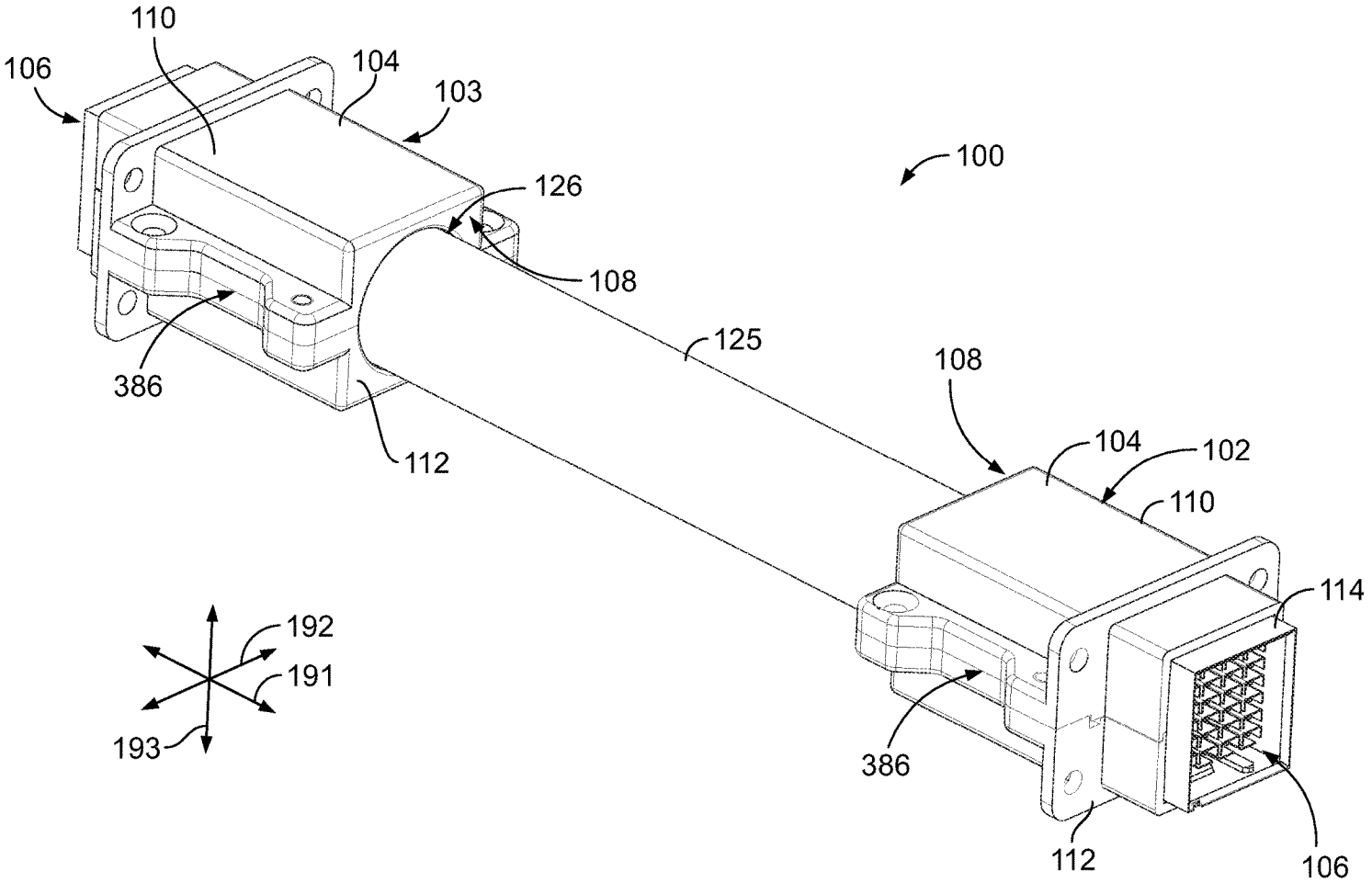
FIG. 1 illustrates a cable assembly formed in accordance with an embodiment.

FIG. 1 is a perspective view of a cable assembly 100 having a first communication device 102, a second communication device 103, and a cable harness 125 that extends between and mechanically and electrically couples the first and second communication devices 102, 103. In particular embodiments, the cable harness 125 has a length that is between about a half meter to about ten meters, but embodiments with other lengths are also possible. As shown, the first and second communication devices 102, 103 are identical devices. As such, description of one of the communication devices 102, 103 is applicable to the other communication device. In other embodiments, the communication devices may be different.

The cable harness 125 is configured to hold numerous insulated wires 244 (shown in FIG. 3) for transmitting data signals between the first and second communication devices 102, 103. The numerous insulated wires 244 may be collectively referred to as a group or a bunch 243. The cable harness 125 may also be referred to as a wire harness, a multicore cable, or multicore cabling. In some embodiments, the cable harness 125 includes a bundle of individual cables or a jacketed bundle of multiple cables. The cable harness 125 is electrically coupled to or grounded to an assembly housing 104 of the first communication device 102, and the cable harness 125 is also electrically coupled to or grounded to an assembly housing 104 of the second communication device 103.

The assembly housing 104 for each of the first and second communication devices 102, 103 is configured to surround electrical components of the respective communication device. In the illustrated embodiment, the assembly housing 104 surrounds an electrical connector 114 and the insulated wires 244 (FIG. 3) from the cable harness 125. In other embodiments, the assembly housing 104 may surround more than one electrical connector. For example, the electrical connectors 114 may be positioned side-by-side or in an ordered arrangement that includes other types of connectors.

The assembly housing 104 includes a conductive material. For example, the assembly housing 104 may be shaped from a dielectric material having conductive elements or fillers. Alternatively, the assembly housing 104 may be plated with a conductive material. For some embodiments, the assembly housing 104 may also be referred to as a device housing or a backshell.

The assembly housing 104 for each of the communication devices 102, 103 has a mating side or face 106 and a loading side or face 108. In the illustrated embodiments, the mating side 106 and the loading side 108 face in opposite directions. In other embodiments, however, the mating side 106 and the loading side 108 may have different positions such that, for example, the mating side 106 and the loading side 108 face in perpendicular directions. The loading side 108 includes a loading passage 126 through which the cable harness 125 passes.

The communication devices 102, 103 are oriented with respect to mutually perpendicular axes 191, 192, 193, which include a mating axis 191, a first lateral axis 192, and a second lateral axis 193. During a mating operation, the mating side 106 for each of the communication devices 102, 103 is configured to engage another communication device (not shown) along the mating axis 191. The communication devices 102, 103 may be moved along the mating axis 191 and/or the other communication device may be moved along the mating axis 191 to engage the communication devices 102, 103. For some applications, the communication devices 102, 103 may be mounted to a system panel or wall for receiving the other communication device.

For some applications, the communication devices 102, 103 may not face in opposite directions. In such applications, and to avoid confusion, each of the communication devices 102, 103 may be oriented with respect to a separate set of axes 191, 192, 193.

In the illustrated embodiment, the assembly housing 104 includes first and second housing shells 110, 112 that are joined together to form the assembly housing 104. The assembly housing 104 holds the electrical connector 114 of the respective communication device at a designated position along the mating side 106. In an exemplary embodiment, the electrical connector 114 of the first and second communication devices 102, 103 are identical to one another. Other embodiments, however, may include different configurations or types of electrical connectors. By way of example, the electrical connector 114 may be a STRADA Whisper connector, commercially available from TE Connectivity.

In some embodiments, the electrical connector 114 is a high speed differential pair electrical connector that includes a plurality of differential pairs of conductors. The cable assembly 100 may be capable of transmitting at least about four (4) gigabits per second (Gbps), at least about 10 Gbps, at least about 20 Gbps, or at least about 40 Gbps.

Figure 2:
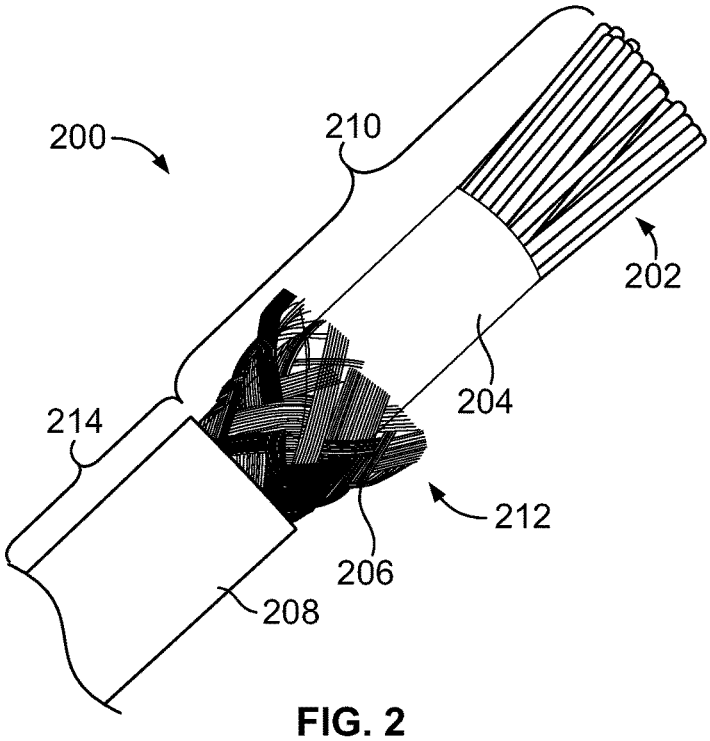
FIG. 2 is an image of an end of a portion of a cable harness that may be used with the cable assembly of FIG. 1.

FIG. 2 is an image of an end of a cable harness 200, which may be incorporated with cable assemblies, such as the cable assembly 100 (FIG. 1). The cable harness 125 (FIG. 1) may be similar or identical to the cable harness 200. For example, the cable harness 200 may include a plurality of communication cables 202, a conductive foil 204 that surrounds the communication cables 202, and a conductive braid 206 that surrounds the conductive foil 204. Optionally, a protective jacket 208 surrounds the conductive braid 206. In some embodiments, the conductive foil 204 and the conductive braid 206 may constitute a shielding layer 212 that is configured to shield the communication cables 202 from electromagnetic interference from adjacent cable harnesses (not shown). In other embodiments, the shielding layer 212 may include only the conductive foil 204 or only the conductive braid 206. Each of the communication cables 202 may include a single insulated wire or multiple insulated wires, such as the insulated wires 244 (shown in FIG. 3).

Figure 10:
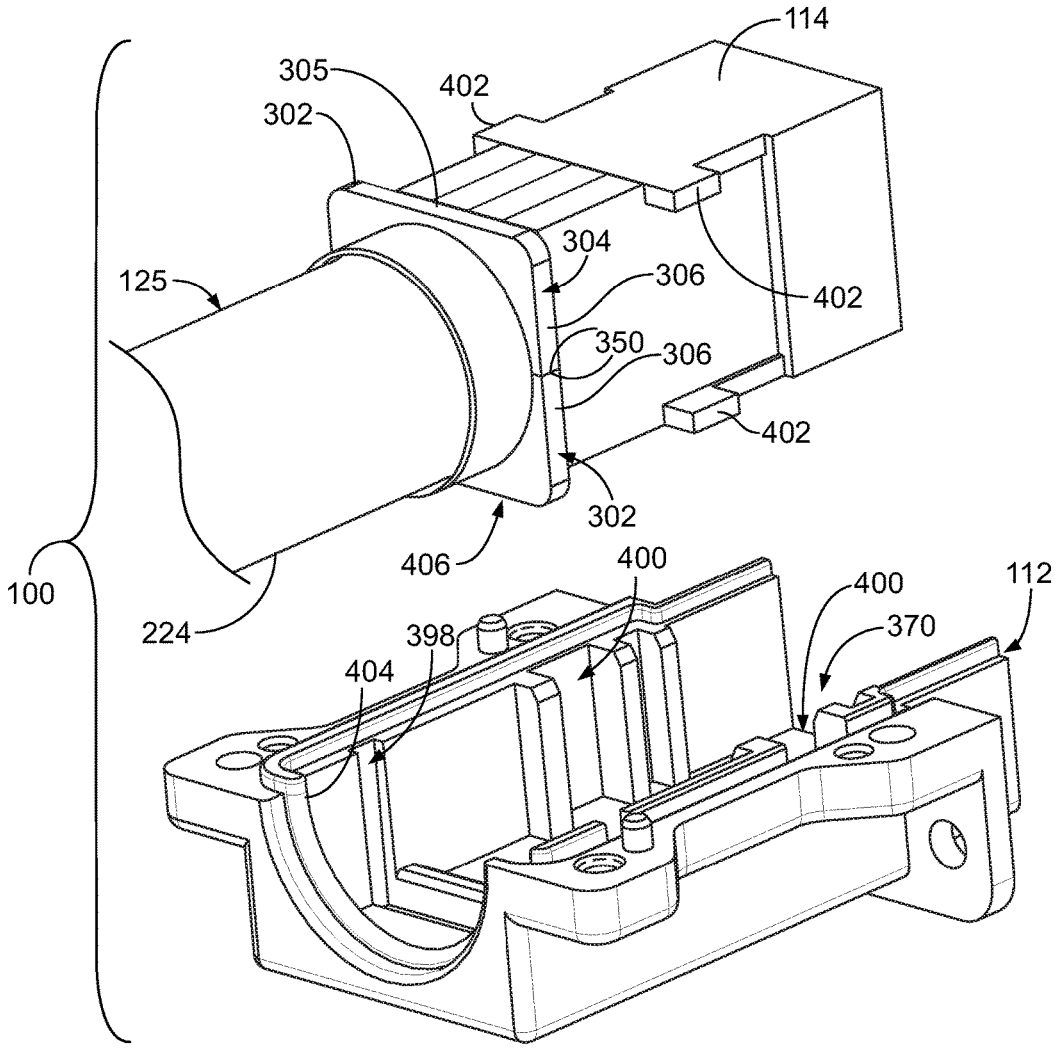
FIG. 10 shows a portion of the cable assembly in which an electrical connector of the cable assembly is poised to be placed within a cavity of one housing shell.

The cable harness 200 includes a covered segment 210 and an external segment 214. Although not shown, the cable harness 200 may include another covered segment at an opposite end of the cable harness 200. The covered segment 210 is a portion of the cable harness 200 that will be surrounded by an assembly housing (not shown), such as the assembly housing 104 (FIG. 1), and partially surrounded by a discrete ferrule (not shown), such as the discrete ferrule 305 (FIG. 10). The external segment 214 is a portion of the cable harness 200 that extends between the covered segments 210. In many applications, the external segment 214 accounts for a majority of a length of the cable harness 200. The external segment 214 may be routed between different equipment.

Figure 3:
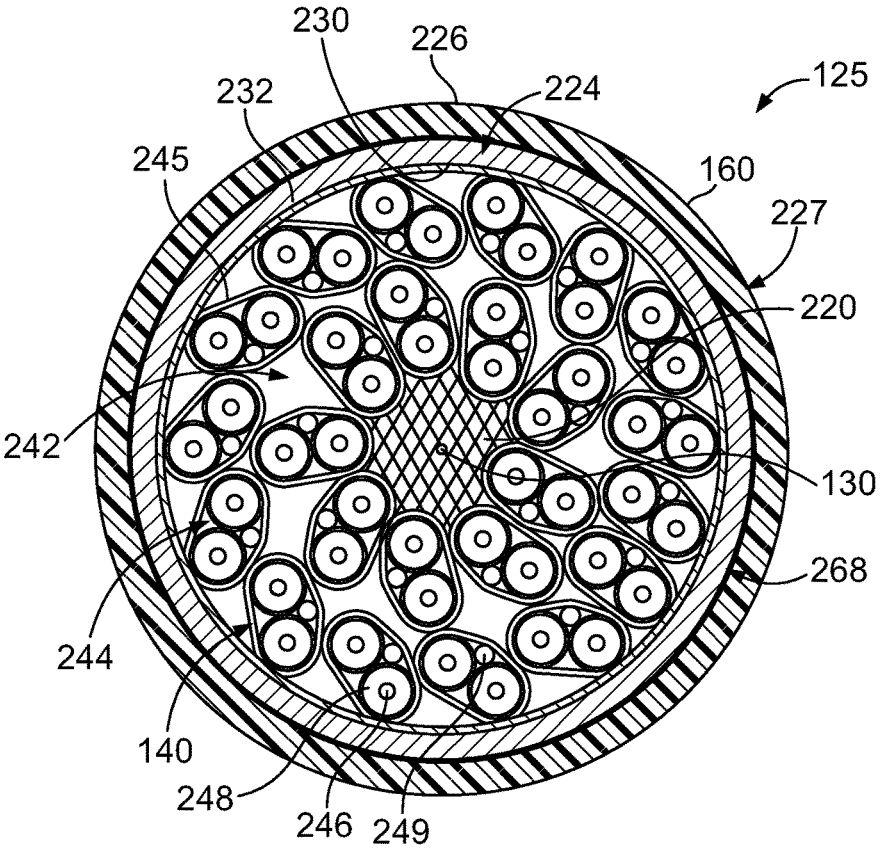
FIG. 3 illustrates a cross-section of a cable harness that may be used with the cable assembly of FIG. 1.

FIG. 3 illustrates a cross-section of an external segment 160 of the cable harness 125. As described above, the cable harness 125 may be similar or identical to the cable harness 200 (FIG. 2). The cable harness 125 includes a central spacer 220 having a central axis 130 of the cable harness 125 extending therethrough. The cable harness 125 also includes a plurality of insulated wires 244 that are positioned around the central spacer 220, a conductive shielding layer 224 that surrounds the insulated wires 244, and a protective jacket 226 that surrounds the shielding layer 224. In some embodiments, a radial space or gap may exist between the shielding layer 224 and the insulated wires 244 or cables 140. The protective jacket has an exterior surface 227, and the shielding layer 224 has an outer surface 268.

As shown, the protective jacket 226 immediately surrounds the shielding layer 224. In other embodiments, a radial space or gap may exist between the protective jacket 226 and the shielding layer 224 and/or an additional protective jacket (not shown) may surround the protective jacket 226 with a radial space between the jackets.

In the illustrated embodiment, the insulated wires 244 are elements of communication cables 140 in which each communication cable 140 includes a pair of the insulated wires 244. The pair of insulated wires 244 may be designed for differential signaling. Although FIG. 3 shows a certain number of insulated wires 244 and communication cables 140, it should be understood that the number of insulated wires 244 and/or communication cables 140 may be selected based on the application of the cable harness 125.

In the illustrated embodiment, the shielding layer 224 includes a conductive foil 230 that surrounds the communication cables 140 and a conductive braid 232 that surrounds the conductive foil 230. In other embodiments, the shielding layer 224 may include only the conductive foil 230 or only the conductive braid 232. The shielding layer 224 defines a cable passage 242 through which the insulated wires 244 and/or the communication cables 140 extend. The cable passage 242 has the central axis 130 extending therethrough such that the central axis 130 extends along a geometric center of the cable passage 242. The cable passage 242 extends along the central axis 130.

As shown, each of the communication cables 140 includes a pair of the insulated wires 244 surrounded by a cable jacket 245. Although not shown, the communication cable 140 may also include a shielding or foil layer that surrounds the insulated wires 244 and is surrounded by the cable jacket 245. Each of the insulated wires 244 includes a signal conductor 246 and an insulative layer 248 that surrounds the corresponding signal conductor 246. Optionally, the communication cable 140 may include a drain wire 249 that extends along the insulated wires 244. In an exemplary embodiment, the communication cables 140 are twin axial cables having two insulated wires 244. In other embodiments, the communication cable 140 may include a twisted-pair of insulated wires 244. The signal conductors 246 may be configured to convey differential signals. Yet in other embodiments, one or more of the communication cables 140 may include more than two insulated wires. Yet in other embodiments, at least some of the insulated wires 244 are independent such that these insulated wires 244 are not paired with another insulated wire.

In particular embodiments, the cable harness 125 is configured to hold numerous insulated wires 244 and/or communication cables 140. For instance, the cable harness 125 may include at least eight (8) insulated wires 244 or, more specifically, at least twelve (12) insulated wires 244. In particular embodiments, the cable harness 125 may include at least twenty-four (24) insulated wires 244 or, more particularly, at least forty-eight (48) insulated wires 244. Likewise, the cable harness 125 may include at least four (4) communication cables 140, at least six (6) communication cables 140, at least twelve (12) communication cables 140, or at least six (24) communication cables 140.

Figure 4:
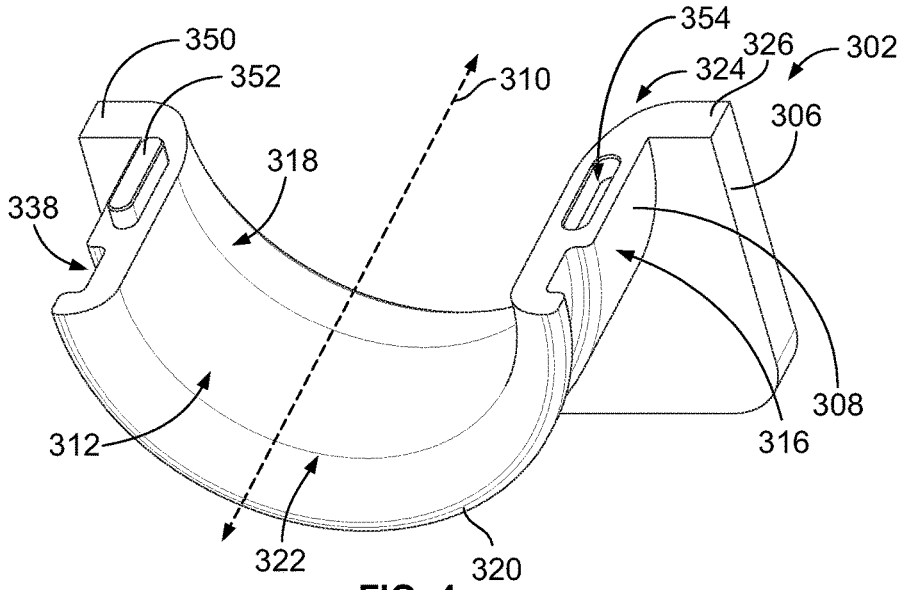
FIG. 4 is an isolated view of a ferrule section that may form part of the cable assembly of FIG. 1.
Figure 5:
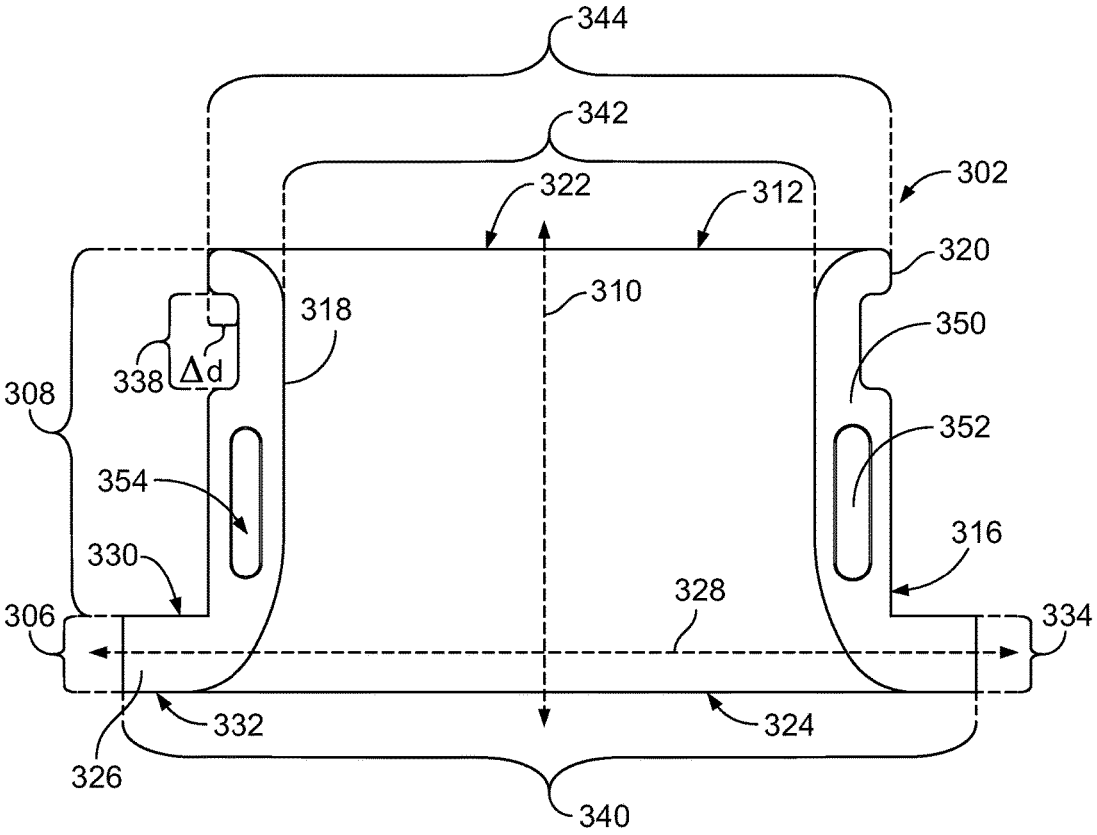
FIG. 5 is a plan view of the ferrule section of FIG. 4.

FIG. 4 is an isolated view of a ferrule section 302 of the cable harness 125 (FIG. 1), and FIG. 5 is an isolated plan view of the ferrule section 302. The ferrule section 302 is configured to be combined with another ferrule section 304 (shown in FIG. 10) to form a discrete ferrule 305 (shown in FIG. 10), which is partially positioned within the cable passage 242 (FIG. 3). To distinguish the elements, the ferrule section 302 may be referred to as the first ferrule section 302, and the ferrule section 304 may be referred to as the second ferrule section 304.

In the illustrated embodiment, the first and second ferrule sections 302, 304 are identically shaped. In other embodiments, the first and second ferrule sections 302, 304 may have different features and/or shapes. Yet in other embodiments, the discrete ferrule 305 (FIG. 10) is a single piece that is shaped to include the features described herein. The ferrule sections 302, 304 (or the discrete ferrule 305) include a conductive material that is suitable for grounding the cable harness 125 to the assembly housing 104.

The following description of the ferrule section 302 may also be applied to the ferrule section 304 (FIG. 10). In the illustrated embodiment, the ferrule section 302 is configured to form essentially half of the discrete ferrule 305 (FIG. 10). In other embodiments, however, one of the ferrule sections may form a majority of the discrete ferrule and/or more than two ferrule sections may be used to form the discrete ferrule. The ferrule section 302 is oriented with respect to a central axis 310. The ferrule section 302 may include a flange portion 306 and a conduit portion 308. The flange portion 306 is configured to engage the assembly housing 104 (FIG. 1), and the conduit portion 308 is configured to define an open-sided ferrule channel 312. The ferrule channels 312 of two ferrule sections 302 combine to form a ferrule passage 492 (shown in FIG. 13). The conduit portion 308 is configured to be positioned within the cable passage 242 (FIG. 3) at an end of the cable passage 242.

The conduit portion 308 of the ferrule section 302 includes an outer section surface 316 and an inner section surface 318. The inner section surface 318 faces inward (e.g., radially-inward) toward the central axis 310 and defines the ferrule channel 312. The outer section surface 316 faces outward (e.g., radially-outward) away from the central axis 310. In the illustrated embodiment, each of the outer and inner section surfaces 316, 318 has a curved contour. In other embodiments, at least portions of the inner section surface 318 and/or the outer section surface 316 are planar. The outer and inner section surfaces 316,318 are not required to have similar shapes.

The conduit portion 308 includes a section lip 320 that defines an opening 322 to the ferrule channel 312. The section lip 320 may be chamfered or shaped to facilitate directing insulated wires through the ferrule. The flange portion 306 also defines an opening 324 to the ferrule channel 312. The flange portion 306 may include an outer wall 326 that extends away from the central axis 310.

As shown in FIG. 5, the outer wall 326 coincides with a plane 328 that is perpendicular to the central axis 310. The outer wall 326 includes a reference (or blocking) surface 330 and a reference (or blocking) surface 332. The reference surfaces 330, 332 face in opposite directions along the central axis 310. The outer wall 326 has a thickness 334 that extends between the reference surfaces 330,332.

In the illustrated embodiment, the outer section surface 316 is shaped to include a recess 338 that opens to an exterior space of the ferrule section 302. As described herein, the recess 338 is sized and shaped to receive the shielding layer 224 (FIG. 3) and a projection 482 (FIG. 12) of the assembly housing 104 (FIG. 1). In alternative embodiments, the outer section surface 316 may be shaped to form a projection and the assembly housing 104 may be shaped to form a recess that receives the projection. Yet in other embodiments, the outer section surface 316 may be shaped to form one or more projections and one or more recesses and the assembly housing 104 may be shaped to form one or more corresponding recesses that receive the projection(s) of the outer section surface 316 and one or more corresponding projections that extend into the recess(es) of the outer section surface 316. Accordingly, one of the assembly housing and the outer ferrule surface includes a projection and the other of the assembly housing and the outer ferrule surface includes a recess that receives the projection.

Also shown in FIG. 5, the flange portion 306 and/or the outer wall 326 has a dimension (e.g., width) 340 that is measured perpendicular to the central axis 310 and/or parallel to the plane 328. The conduit portion 308 has a first dimension (e.g., inner diameter) 342 and a second dimension (e.g., outer diameter) 344. The first dimension 342 is a dimension of the ferrule channel 312 and is defined between opposing portions of the inner section surface 318. The second dimension 344 is a dimension of the conduit portion 308 and is defined between opposite portions of the outer section surface 316. As shown, the dimension 340 is greater than the second dimension 344 of the conduit portion 308. The second dimension 344 varies to form the recess 338. FIG. 5 shows a $\Delta d$, which represents the change in the second dimension 344 to form the recess 338. The value of $\Delta d$ may also represent the depth of the recess 338. $\Delta d$ is not required to be the same on both sides of the recess 338. For example, the second dimension 344 may be reduced by X and then increased by 2X.

In FIGS. 4 and 5, the ferrule section 302 includes a platform or ledge surface 350. The platform surface 350 is configured to engage the platform surface of the other ferrule section 304 when the ferrule sections 302, 304 are combined to form the discrete ferrule 305 (FIG. 10). The platform surface 350 extends along the flange portion 306 and the conduit portion 308.

The platform surface 350 may include a ridge 352 and a depression 354. The ridge 352 is sized and shaped to receive the depression of the other ferrule section, and the depression 354 is sized and shaped to receive the ridge of the other ferrule section. The ridge 352 and surfaces that define the depression 354 may form an interference fit to secure the first and second ferrule sections 302, 304 to one another. Alternatively or in addition to forming an interference fit, the shielding layer 224 (FIG. 3) may generate compressive forces that hold the first and second ferrule sections 302, 304 to one another.

Figure 6:
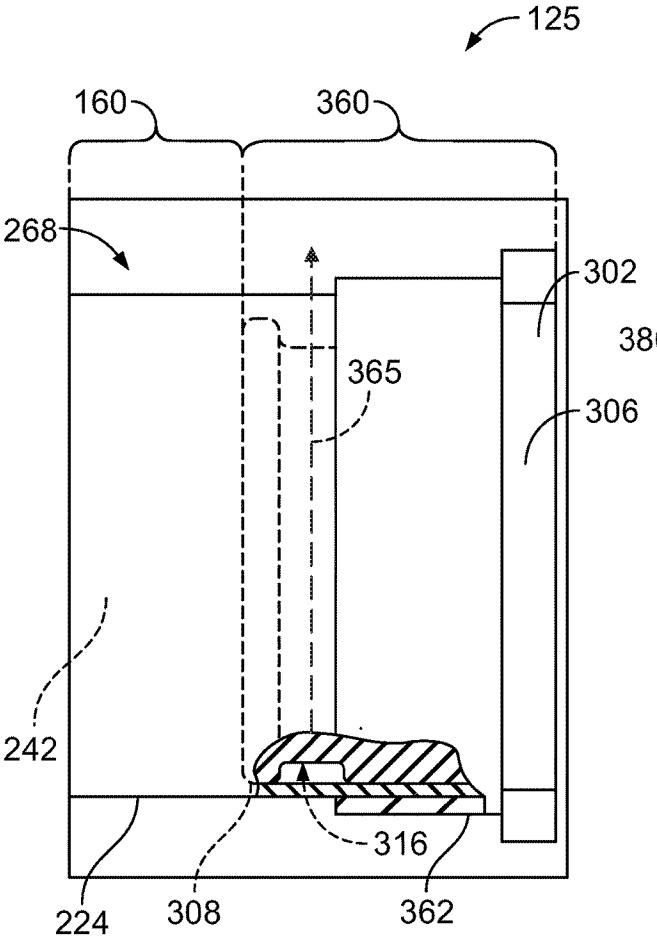
FIG. 6 shows a covered segment of a cable harness that may be used with the cable assembly of FIG. 1.

FIG. 6 shows a covered segment 360 and a portion of the external segment 160 of the cable harness 125, which is partially sectioned in FIG. 6. The conduit portion 308 of the first ferrule section 302 is positioned within an end of the cable passage 242 and is shown in phantom, and the flange portion 306 is disposed outside of the cable passage 242. As shown, the shielding layer 224 surrounds the conduit portion 308. The discrete ferrule 305 (FIG. 10) is configured to be positioned at least partially within the cable passage 242.

In some embodiments, the cable harness 125 includes an outer securing member 362 that surrounds the shielding layer 224. The outer securing member 362 may generate compressive forces that press the shielding layer 224 against the outer section surfaces 316 of the first ferrule section 302 and the second ferrule section 304 (FIG. 10). The outer securing member 362 may be, for example, a band or collar that extends entirely around the discrete ferrule 305 (FIG. 10). The securing member 362 may be, for example, an elastic band or a rigid collar that is formed around the shielding layer 224. As shown, the flange portion 306 extends away from the central axis 310 and clears the outer surface 268 of the shielding layer 224.

The shielding layer 224 is configured to ground the cable harness 125 to the assembly housing 104 (FIG. 1). In some embodiments, the shielding layer 224 is a conductive tape that is helically wrapped about the communication cables 140 (or insulated wires 244). In other embodiments, the shielding layer 224 may be molded or extruded using a conductive thermoplastic. Optionally, the shielding layer 224 may include a foil that extends along the inside or outside of the shielding layer 224.

Figure 7:
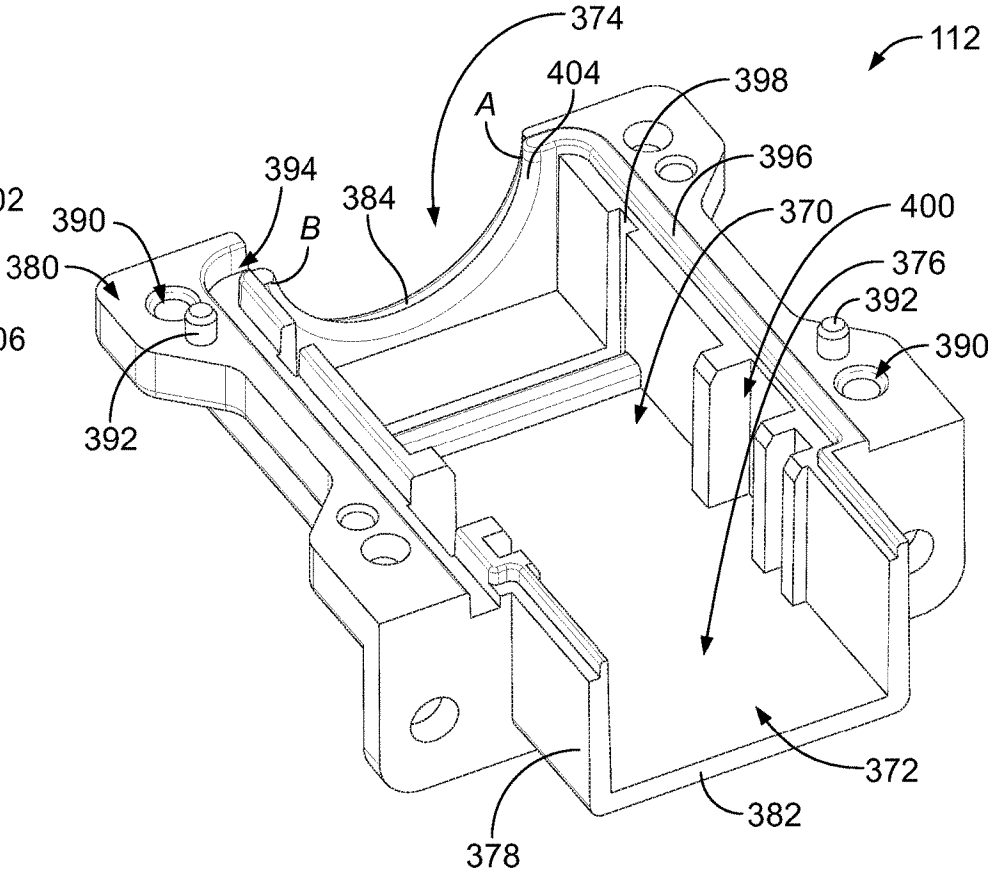
FIG. 7 is a perspective view of a housing shell that may be used with the cable assembly of FIG. 1.

FIG. 7 is a perspective view of the second housing shell 112. The second housing shell 112 is configured to be coupled to the first housing shell 110 (FIG. 1) to form the assembly housing 104 (FIG. 1). In some embodiments, the first and second housing shells 110, 112 are identically shaped. In other embodiments, however, the first and second housing shells 110, 112 may have different shapes and/or different features. In other embodiments, the assembly housing 104 may include more than two housing shells. Yet in other embodiments, the assembly housing 104 may comprise a single continuous body that is shaped (e.g., molded or die-cast or 3D-printed) to form essentially the entire assembly housing 104.

The following description or portions thereof may also be applicable to the housing shell 110 (FIG. 1). It should be understood, however, that the housing shells 110, 112 are not required to be identical for some embodiments. The housing shell 112 defines a shell channel 370, which may also be referred to as a cavity portion. When the housing shells 110, 112 are mated together, the shell channels 370 combine to form an interior cavity 470 (shown in FIG. 12) of the assembly housing 104 (FIG. 1).

The housing shell 112 defines a mating channel opening 372 and a loading channel opening 374. In the illustrated embodiment, the mating channel opening 372 and the loading channel opening 374 are on opposite ends of the housing shell 112 and the shell channel 370 extends therebetween. In other embodiments, such as embodiments in which the electrical connector 114 (FIG. 1) is a right-angle connector, the mating channel opening 372 and the loading channel opening 374 may open in perpendicular directions.

The housing shell 112 defines an inner shell surface 376, an outer shell surface 378, and a border surface 380. The inner shell surface 376 defines the shell channel 370. The outer shell surface 378 represents an exterior of the housing shell 112. The shell channel 370 is sized and shaped to receive at least a portion of the electrical connector 114 (FIG. 1). The mating channel opening 372 is defined by an inner edge 382 of the housing shell 112. The inner edge 382 surrounds the electrical connector 114 when the cable assembly 100 (FIG. 1) is fully constructed. The loading channel opening 374 is sized and shaped relative to the cable harness 125 (FIG. 1). The loading channel opening 374 is defined by an inner edge 384 of the housing shell 112.

The border surface 380 is configured to abut or border an opposing border surface 380 of the other housing shell 110 to define a shell-to-shell interface 386 (FIG. 1) therebetween. The border surface 380 includes a plurality of border surface features, such as thru-holes, recesses, channels, openings, posts, projections, ridges, and the like. The border surface features are designed to mate with complementary border surface features of the other housing shell 110. For example, the border surface 380 includes thru-holes 390 and posts 392. The thru-holes 390 are configured to receive posts (not shown) of the housing shell 110, and the posts 392 are configured to extend into thru-holes (not shown) of the housing shell 110. The border surface 380 also defines an elongated channel 394 and an elongated ridge 396. The elongated channel 394 is configured to receive an elongated ridge (not shown) of the housing shell 110, and the elongated ridge 396 is configured to extend into an elongated channel (not shown) of the housing shell 110.

The elongated ridge 396 extends into a forms a projection 404 that extends around the loading channel opening 374. In other embodiments, the projection 404 is not connected to the elongated ridge 396. As shown, the projection 404 extends inward and surrounds the loading channel opening 374. The projection 404 may extend in a radial direction with respect to a central axis, such as the central axis 130. The projection 404 is a rim that extends continuously (e.g., without changing shape) from one side of the housing shell 112 (identified at point A) to another side of the housing shell 112 (identified at point B). The points A and B are located on the border surface 380 and are opposite one another. In other embodiments, a plurality of projections may exist that are separated by gaps or recesses.

The inner shell surface 376 of the housing shell 112 is shaped to include a plurality of cavity portions. For example, the inner shell surface 376 defines a flange-receiving portion 398 of the shell channel 370 that is sized and shaped to receive the flange portion 306 (FIG. 4) of at least one ferrule section. The inner shell surface 376 also defines a lug-receiving portion 400 of the shell channel 370 that is sized and shaped to receive lugs 402 (shown in FIG. 10) of at least one ferrule section. The portions of the inner shell surface 376 that define the flange-receiving portion 398 and the lug-receiving portion 400 are configured to engage the discrete ferrule 305 and the electrical connector 114 therein to facilitate securing an axial position of the discrete ferrule 305 and the electrical connector 114.

Figure 8:
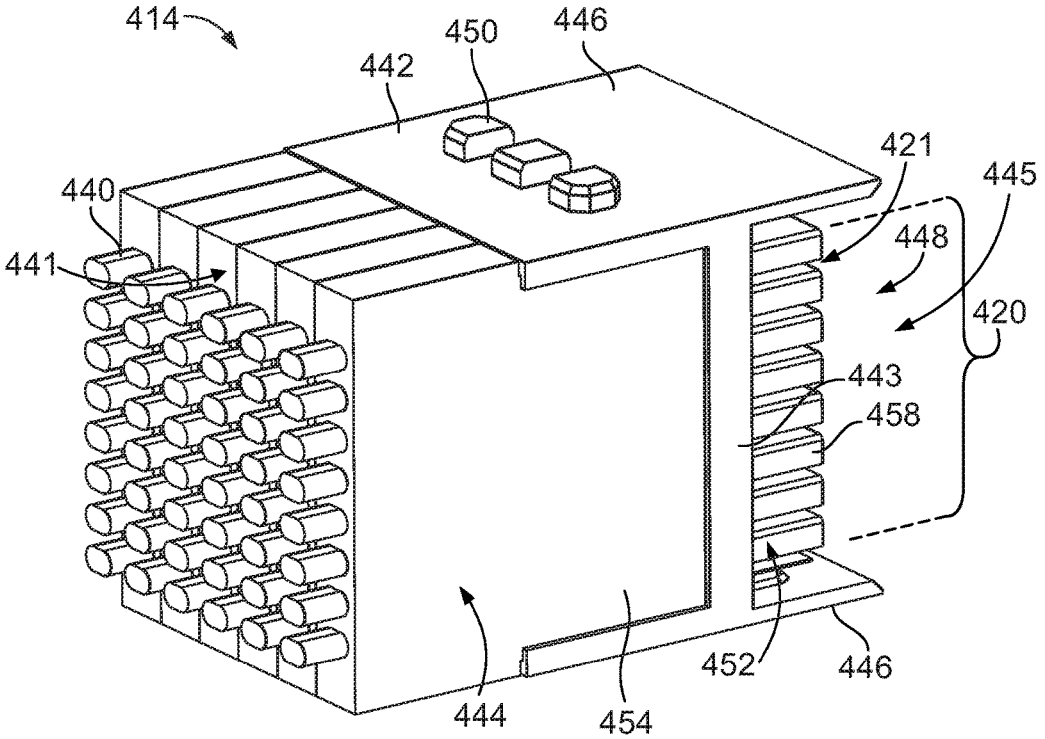
FIG. 8 is a side perspective view of an electrical connector that may be used with the cable assembly of FIG. 1.
Figure 9:
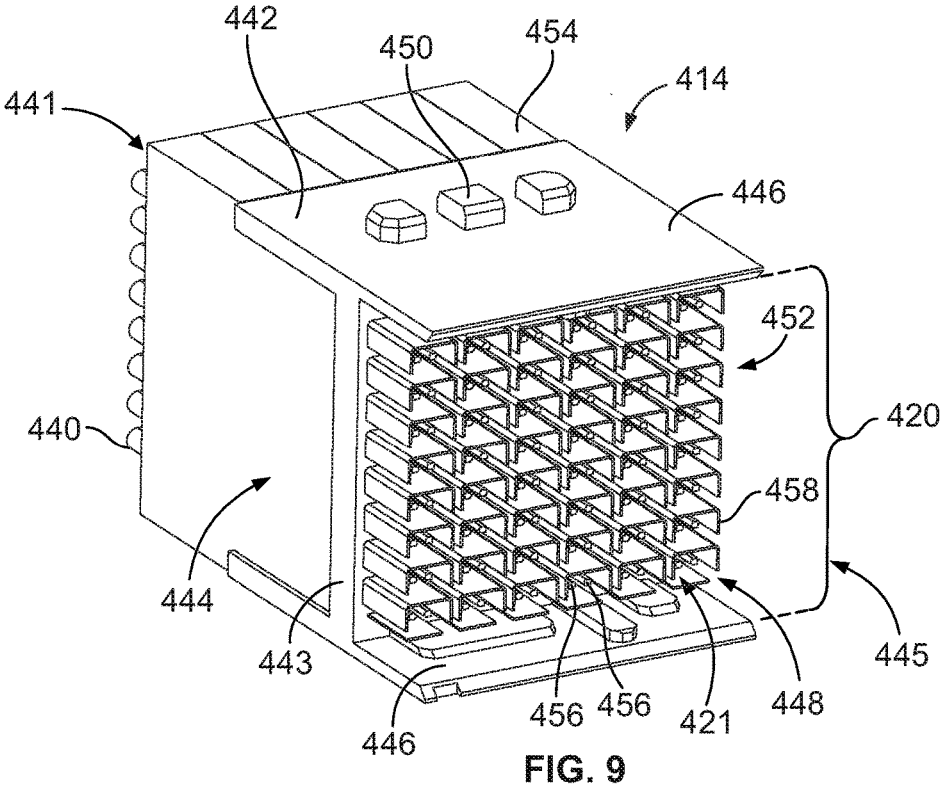
FIG. 9 is a front perspective view of the electrical connector that may be used with the cable assembly of FIG. 1.
Figure 12:
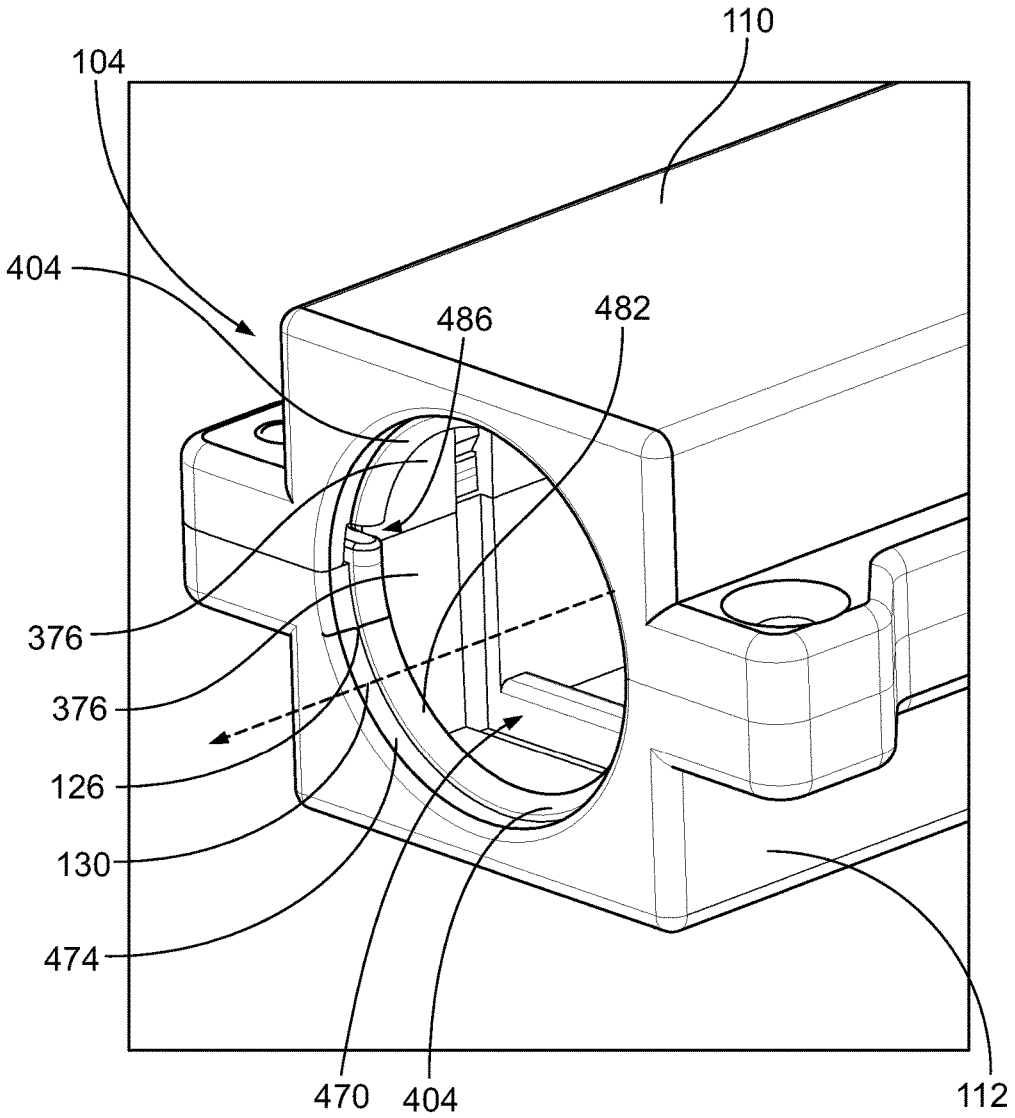
FIG. 12 is an isolated view of the assembly housing of the cable assembly of FIG. 1.

FIGS. 8 and 9 illustrate different perspective views of an electrical connector 414. The electrical connector 414 may be similar to the electrical connector 114 (FIG. 1) and replace the electrical connector 114 in other embodiments. The electrical connector 414 is coupled to a plurality of individual communication cables 440. The electrical connector 414 has a back end 441 that is configured to be surrounded by the assembly housing, such as the assembly housing 104 (FIG. 1), and disposed within an interior cavity, such as the interior cavity 470 (FIG. 12). The electrical connector 414 also has a front end 445 that is configured to engage an external mating connector. The front and back ends 445, 441 are opposite in FIGS. 8 and 9, but are not required to be in alternative embodiments.

The electrical connector 414 includes a connector body or housing 442 that holds a contact assembly 420 positioned at the front end 445. For instance, in the illustrated embodiment, the connector body 442 holds a plurality of contact modules 444 that each include a portion of the contact assembly 420. The connector body 442 includes a base wall 443 and shroud walls 446 that extend from the base wall 443 to define a mating cavity or space 448 therebetween. The mating cavity 448 is configured to receive a portion of the other communication device (not shown). For example, the electrical connector 414 may be configured to engage a corresponding mating connector (not shown). The shroud walls 446 may guide mating of the mating connector with the electrical connector 414. In an exemplary embodiment, the connector body 442 has lugs 450 extending outward from the shroud walls 446.

The contact assembly 420 includes electrical contacts 421 that may be arranged to form a plurality of contact sub-assemblies 452. In some embodiments, the contact assembly 420 may be characterized as a contact array of the electrical contacts 421. For example, each of the contact modules 444 includes a plurality of contact sub-assemblies 452 and a support body 454 that holds the contact sub-assemblies 452 of the corresponding contact module 444. The electrical contacts 421 of each contact sub-assembly 452 include a pair of signal contacts 456 (FIG. 9) and a ground contact (or ground shield) 458. Each of the signal contacts 456 may be terminated to a corresponding signal conductor, such as the signal conductor 246 (shown in FIG. 3), of the individual communication cables 440. In an exemplary embodiment, the ground contact 458 peripherally surrounds the signal contacts 456 along a length of the signal contacts 456 to ensure that the signal paths are electrically shielded from interference.

The support body 454 provides support for the contact sub-assemblies 452. The communication cables 440 extend into the corresponding support body 454 such that the support body 454 holds a portion of the communication cables 440. The support body 454 may provide strain relief for the communication cables 440. Optionally, the support body 454 may be manufactured from a plastic material. Alternatively, the support body 454 may be manufactured from a metal material. The support body 454 may be a metalized plastic material to provide additional shielding for the communication cables 440 and the contact sub-assemblies 452. Optionally, the support body 454 may include a metal plate electrically connected to each ground contact 458 to electrically common each ground contact 458. The support body 454 may also include a dielectric material that is overmolded around the communication cables 440 and portions of the metal plate to support the communication cables 440 and the contact sub-assemblies 452.

In an exemplary embodiment, multiple contact modules 444 may be loaded into the connector body 442. The connector body 442 holds the contact modules 444 in parallel such that the contact sub-assemblies 452 are aligned in parallel columns. Any number of contact modules 444 may be held by the connector body 442 depending on the particular application. When the contact modules 444 are stacked in the connector body 442, the contact sub-assemblies 452 may also be aligned in rows.

It should be understood, however, that the electrical connector 414 described above and illustrated in the drawings is only one example of an electrical connector that may be incorporated into embodiments set forth herein. In alternative embodiments, the communication devices 102, 103 (FIG. 1) includes other configurations or types of electrical connectors. In other embodiments, the communication devices 102, 103 includes multiple electrical connectors.

FIG. 10 shows a portion of the cable assembly 100 in which the electrical connector 114 is secured to the cable harness 125 and poised to be placed within the shell channel 370 of the housing shell 112. As shown, the flange portions 306 of the first and second ferrule sections 302, 304 combine to form an external flange 406 of the discrete ferrule 305. The platform surfaces 350 of the ferrule sections 302, 304 engage each other along a section-to-section interface. The external flange 406 is aligned to be received by the flange-receiving portions 398 of the housing shell 112. The lugs 402 of electrical connector 114 are aligned to be received by the lug-receiving portions 400 of the housing shell 112.

Figure 11:
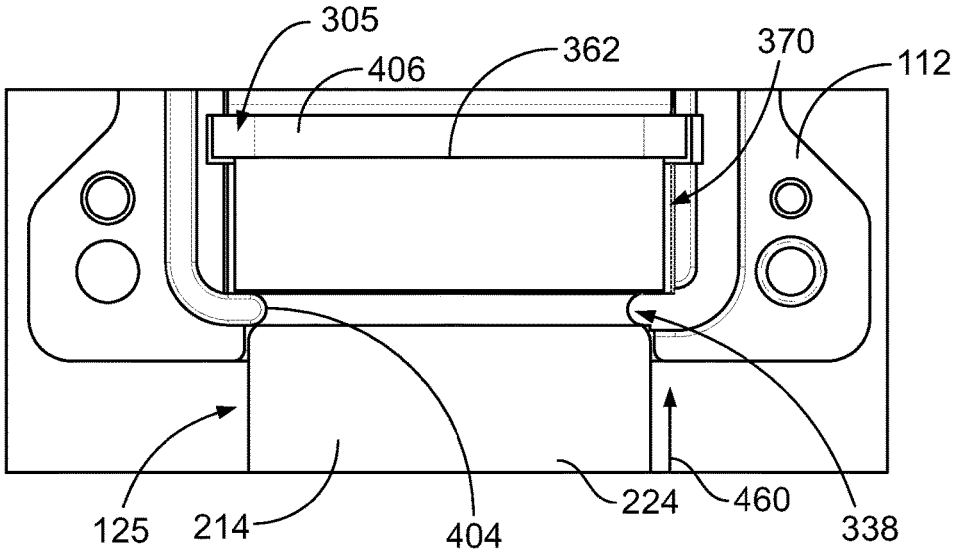
FIG. 11 shows the covered segment of the cable harness secured to the one housing shell.

FIG. 11 illustrates the cable harness 125 positioned within the shell channel 370 of the housing shell 112. The outer securing member 362 surrounds the shielding layer 224 and the conduit portions 308 (FIG. 4) of the discrete ferrule 305. The external flange 406 is disposed within the shell channel 370. During assembly, as the electrical connector 114 (FIG. 10) is positioned within the shell channel 370, the projection 404 engages the shielding layer 224 and is permitted to stretch the shielding layer 224 into the recess 338 of the ferrule section 302 (FIG. 4). As indicated by arrow 460, a tensile force caused by the projection 404 engaging the shielding layer 224 may pull or stretch the shielding layer 224 that extends longitudinally along the external segment 214. Slack along the external segment 214 of the shielding layer 224 and/or an inherent elasticity of the shielding layer 224 may allow the shielding layer 224 to be moved into the recess 338.

After the electrical connector 114 (FIG. 10) is positioned within the shell channel 370, the housing shell 110 (FIG. 1) may be coupled to the housing shell 112 to define the interior cavity 470 (FIG. 12) therebetween where at least a portion of the electrical connector 114 is located and at least a portion of the cable harness 125 is located. In a similar manner, as the housing shell 110 is coupled to the remainder of the cable assembly 100 (FIG. 1), the projection 404 of the housing shell 110 engages the shielding layer 224 of the cable harness 125 and stretches the shielding layer 224 into the recess 338 of the ferrule section 304 (FIG. 10). When fully assembled, the projections 404 may form a single continuous projection or rim. In other embodiments, one or more gaps may exist between different projections. Such gaps may be filled by other material of the assembly housing 104 (FIG. 1).

FIG. 12 is an isolated view of the assembly housing 104. The cable harness 125 (FIG. 1) and other elements of the cable assembly 100 (FIG. 1) have been removed to illustrate features of the assembly housing 104. The assembly housing 104 has an interior cavity 470 and the loading passage 126 that provides access to the interior cavity 470. The assembly housing 104 has an inner housing surface 474 that defines the loading passage 126. The inner housing surface 474 is formed by the inner shell surfaces 376 of the housing shells 110, 112.

As shown, the projections 404 of the housing shells 110, 112 are aligned within one another to surround nearly the entire loading passage 126. At least one gap 486 may exist between the projections 404. The gap 486 may provide additional space to accommodate any pinched or bunched portions of the shielding layer 224. Combined, the projections 404 may form a projection 482 of the assembly housing 404. The gap 486 is a gap within the projection 482.

Figure 13:
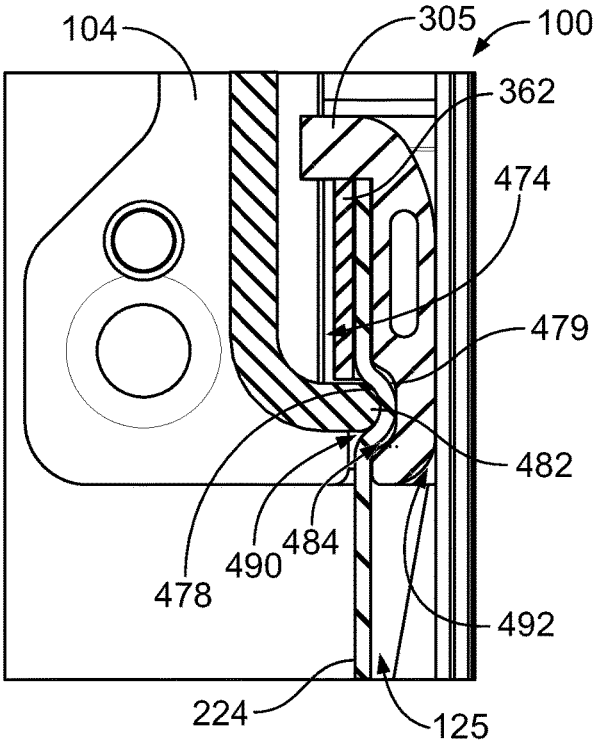
FIG. 13 is a cross-section of a portion of the cable assembly illustrating a harness-housing seam.

FIG. 13 is a cross-section of a portion of the fully constructed cable assembly 100. The discrete ferrule 305 has an outer ferrule surface 478 that is directly surrounded by the shielding layer 224. In the illustrated embodiment, the outer ferrule surface 478 is formed by the outer section surfaces 316 (FIG. 4) of the first and second ferrule sections 302, 304.

Embodiments include a harness-housing seam 490 that is defined between the inner housing surface 474 of the assembly housing 104 and the outer ferrule surface 478 of the discrete ferrule 305. The harness-housing seam 490 may extend essentially entirely around the central axis 130. In the illustrated embodiment, each of the first and second housing shells 110, 112 (FIG. 12) may include a portion of the inner housing surface 474 that forms the harness-housing seam 490.

As shown in FIG. 13, an inner housing surface 474 includes the projection 482 of the assembly housing 104 and the outer ferrule surface 478 includes a recess 484. The recess 484 is defined by the recesses 338 (FIG. 4) of the first and second ferrule sections 302, 304. As described herein, the inner housing surface 474 may include a recess and the outer shell surface 378 may include a projection in other embodiments. The shielding layer 224 is stretched by the projection 482 within the harness-housing seam 490 and electrically grounds the cable harness 125 to the assembly housing 104. Also shown, the outer securing member 362 compresses the shielding layer 225 against the discrete ferrule 305.

The outer ferrule surface 478 forms a grounding perimeter 479. The grounding perimeter 479 includes the recess 482 and extends around the central axis 130 of the cable harness 100, which is shown in FIG. 12 with the cable harness removed. The grounding perimeter 479 coincides with a plane 365 (shown in FIG. 6 for illustrative purposes) that is perpendicular to the central axis 130. In some embodiments, the grounding perimeter 479 is devoid of a projection. For example, the recess 482 may extend entirely around the central axis 130 and coincide with the plane 365. In alternative embodiments, the grounding perimeter 479 includes a projection or ridge.

Figure 14:
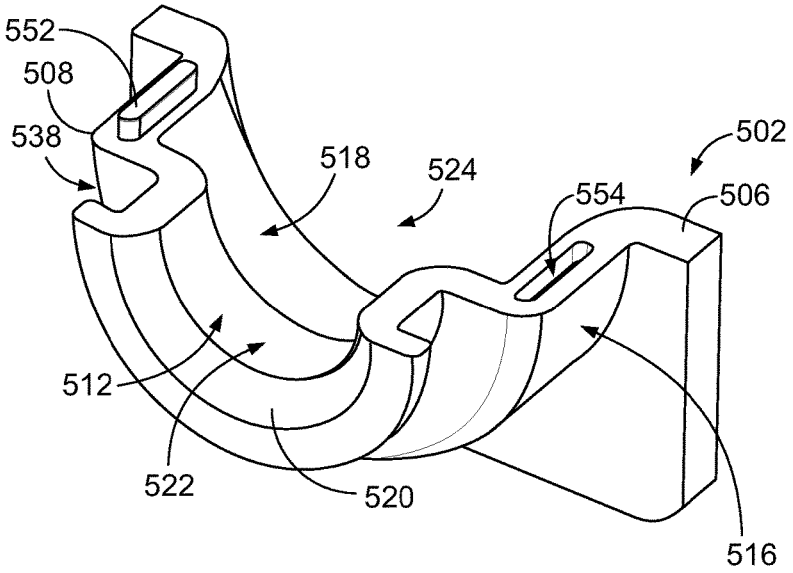
FIG. 14 is an isolated view of a ferrule section that may form part of the cable assembly of FIG. 1.
Figure 15:
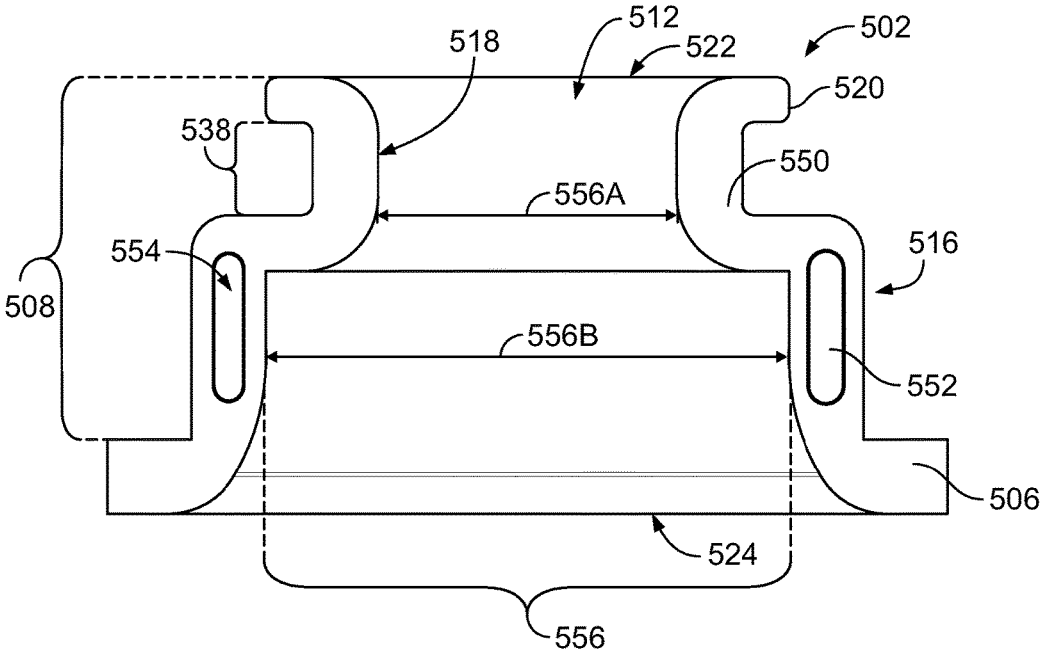
FIG. 15 is a plan view of the ferrule section of FIG. 14.

FIG. 14 is an isolated view of a ferrule section 502 and FIG. 15 is a plan view of the ferrule section 502. The ferrule section 502 may include similar features as the ferrule section 302 (FIG. 4). The ferrule section 502 is configured to be combined with another ferrule section (not shown) to form a discrete ferrule (not shown) that is similar to the discrete ferrule 305.

For example, the ferrule section 502 may include a flange portion 506 and a conduit portion 508. The conduit portion 508 of the ferrule section 502 includes an outer section surface 516 and an inner section surface 518. The inner section surface 518 faces inward (e.g., radially-inward). The outer section surface 516 faces outward (e.g., radially-outward). In the illustrated embodiment, each of the outer and inner section surfaces 516, 518 has a curved contour. In other embodiments, at least portions of the inner section surface 518 and/or the outer section surface 516 are planar. The outer and inner section surfaces 516,518 are not required to have similar shapes.

The conduit portion 508 includes a section lip 520 that defines an opening 522 to an open-sided ferrule channel 512. The section lip 520 may be chamfered or shaped to facilitate directing insulated wires during assembly. The flange portion 506 also defines an opening 524 to the ferrule channel 512.

In the illustrated embodiment, the outer section surface 516 is shaped to include a recess 538 that opens to an exterior space of the ferrule section 502. In FIGS. 14 and 15, the ferrule section 502 includes a platform or ledge surface 550. The platform surface 550 is configured to engage the platform surface of the other ferrule section when the ferrule sections are combined. The platform surface 550 extends along the flange portion 506 and the conduit portion 508.

The platform surface 550 may include a ridge 552 and a depression 554. The ridge 552 is sized and shaped to receive the depression of the other ferrule section, and the depression 554 is sized and shaped to receive the ridge of the other ferrule section. The ridge 552 and surfaces that define the depression 554 may form an interference fit to secure the ferrule sections together.

The inner section surface 518 defines an inner diameter 556 of the ferrule section 502. For embodiments in which the ferrule sections of the discrete ferrule are identical, the inner section surface 518 represents an inner ferrule surface that has the same inner diameter 556. The inner diameter 556 includes a first inner diameter 556A and a second inner diameter 556B that is greater than the first inner diameter 556A. The differences in the first and second inner diameters 556A, 556B provide a tapered configuration that may allow easier handling and protection of the insulated wires. The second diameter 556B occurs closer to an end of the corresponding cable harness.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A cable assembly comprising:

an assembly housing having an interior cavity and a loading passage that provides access to the interior cavity, the assembly housing having an inner housing surface that defines the loading passage;

an electrical connector having a back end disposed within the interior cavity and surrounded by the assembly housing, the electrical connector having a front end that is configured to engage an external mating connector; and a cable harness including insulated wires and a conductive shielding layer, the insulated wires extending through a cable passage defined by the shielding layer, the cable harness also including a discrete ferrule positioned within the cable passage at an end of the cable passage, the discrete ferrule having an outer ferrule surface that is surrounded by the shielding layer;

wherein the inner housing surface and the outer ferrule surface interface each other along a harness-housing seam, the harness-housing seam including a projection and a recess that receives the projection, the shielding layer being stretched by the projection within the harness-housing seam and electrically grounding the cable harness to the assembly housing.

2. The cable assembly of claim 1, wherein the discrete ferrule has an external flange disposed outside of the cable passage and within the interior cavity, the external flange engaging the assembly housing and securing the cable harness to the assembly housing.

3. The cable assembly of claim 1, wherein the cable harness includes an outer securing member at a covered segment of the cable harness, the securing member surrounding the shielding layer and holding the shielding layer to the discrete ferrule such that the shielding layer is disposed between the securing member and the discrete ferrule.

4. The cable assembly of claim 1, wherein the outer ferrule surface includes the recess and the inner housing surface includes the projection.

5. The cable assembly of claim 1, wherein the cable passage has a central axis, the projection extending in a radial direction with respect to the central axis.

6. The cable assembly of claim 5, wherein the harness-housing seam extends essentially entirely around the central axis.

7. The cable assembly of claim 1, wherein the harness-housing seam has a gap that is approximately equal to a thickness of the shielding layer.

8. The cable assembly of claim 1, wherein the assembly housing includes first and second housing shells, the first and second housing shells defining portions of the loading passage.

9. The cable harness of claim 8, wherein each of the first and second housing shells includes a portion of the inner housing surface that forms the harness-housing seam.

10. The cable assembly of claim 1, wherein the electrical connector includes a contact array comprising a plurality of contact sub-assemblies, each contact sub-assembly including a pair of signal contacts and a ground contact that surrounds the pair of signal contacts, wherein the electrical connector is configured to transmit data signals at a data rate of at least 10 gigabits per second.

11. The cable assembly of claim 10, wherein the insulated wires includes at least twenty-four (24) of the insulated wires.

12. A cable harness comprising:

a conductive shielding layer defining a cable passage that extends along a central axis;

a group of insulated wires surrounded by the shielding layer and extending through the cable passage;

a discrete ferrule positioned at least partially within the cable passage at an end of the cable passage, the discrete ferrule surrounding the group of insulated wires, the discrete ferrule having an outer ferrule surface, the shielding layer directly surrounding the outer ferrule surface;

wherein the outer ferrule surface includes a grounding perimeter, the grounding perimeter including at least one of a projection or a recess and extending around the central axis, the grounding perimeter coinciding with a plane that is perpendicular to the central axis, the shielding layer extending over the grounding perimeter.

13. The cable harness of claim 12, wherein the discrete ferrule has an external flange disposed outside of the cable passage.

14. The cable harness of claim 12, further comprising an outer securing member at a covered segment of the cable harness, the securing member surrounding and holding the shielding layer to the discrete ferrule such that the shielding layer is disposed between the securing member and the discrete ferrule.

15. The cable harness of claim 12, wherein the grounding perimeter is devoid of a projection.

16. The cable harness of claim 12, wherein the cable passage has a central axis, the grounding perimeter extending essentially entirely around the central axis.

17. The cable harness of claim 12, wherein the discrete ferrule has an inner ferrule surface that defines an inner diameter of the discrete ferrule, the inner diameter including a first inner diameter and a second inner diameter that is greater than the first inner diameter, the first inner diameter of the discrete ferrule coinciding with the plane, the second diameter of the discrete ferrule occurring closer to an end of the cable harness.

18. The cable harness of claim 12, wherein the discrete ferrule includes multiple ferrule sections that are coupled to one another.

19. The cable harness of claim 12, wherein the discrete ferrule includes first and second ferrule sections, each of the first and second ferrule sections defining an open-sided ferrule channel, the ferrule channels combining to form a ferrule passage, the insulated wires extending through the ferrule passage.

20. The cable harness of claim 12, wherein the group of insulated wires includes at least twenty-four (24) of the insulated wires.

* * * * *